US012590468B2

(12) United States Patent
Witelson et al.

(10) Patent No.: US 12,590,468 B2
(45) Date of Patent: Mar. 31, 2026

(54) POOL RELATED PLATFORM AND ADDED-ON ACCESSORIES

(71) Applicant: Maytronics Ltd., Kibutz Yizrael (IL)

(72) Inventors: Shay Witelson, Kibbutz Yizrael (IL); Avshalom Kehati, Zikhron Yaakov (IL)

(73) Assignee: Maytronics Ltd., Kibutz Yizrael (IL)

( * ) Notice: Subject to any disclaimer, the term of this patent is extended or adjusted under 35 U.S.C. 154(b) by 76 days.

(21) Appl. No.: 18/259,776

(22) PCT Filed: May 16, 2023

(86) PCT No.: PCT/IB2023/055042
§ 371 (c)(1),
(2) Date: Jun. 29, 2023

(87) PCT Pub. No.: WO2023/223212
PCT Pub. Date: Nov. 23, 2023

(65) Prior Publication Data

US 2024/0392599 A1 Nov. 28, 2024

(30) Foreign Application Priority Data

May 16, 2022 (IL) ..... 293052

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS

| | | | | |
|---|---|---|---|---|
| 11,149,458 | B1 * | 10/2021 | Mjelde | E04H 4/1636 |
| 2016/0340006 | A1 * | 11/2016 | Tang | B63C 9/01 |
| 2017/0248568 | A1 | 8/2017 | Yizhack et al. | |
| 2018/0365394 | A1 | 12/2018 | Bennett et al. | |
| 2019/0106897 | A1 | 4/2019 | Ben | |
| 2019/0257807 | A1 | 8/2019 | Witelson et al. | |
| 2019/0284827 | A1 | 9/2019 | Witelson et al. | |
| 2021/0324650 | A1 | 10/2021 | Witelson et al. | |
| 2022/0003015 | A1 * | 1/2022 | Witelson | B60L 50/50 |
| 2022/0003542 | A1 | 1/2022 | Napier et al. | |
| 2023/0208473 | A1 * | 6/2023 | Rachman | H04B 3/54 375/257 |

FOREIGN PATENT DOCUMENTS

DE 102018202505 A1 8/2019

* cited by examiner

*Primary Examiner* — Michael D Jennings
(74) *Attorney, Agent, or Firm* — Reches Patents

(57) ABSTRACT

A pool related platform that includes a body, a detachable sensor unit (DSU) that comprises multiple sensors and is detachably coupled to the body; and at least one power supply element.

15 Claims, 14 Drawing Sheets

POOL RELATED PLATFORM AND ADDED-ON ACCESSORIES

CROSS REFERENCE

This application claims priority from Israeli Patent application 293052 filing date May 16 2022, which is incorporated herein in its entirety.

FIELD OF INVENTION

The present invention relates to systems, methods and kits for providing submerged electromagnetic or galvanic power connections to power electronic add-on attachments such as: a camera, a sensor or sensors, devices or accessories. The said systems may be suitable for wireless electrical powering and charging, for two-way data transfers or for both. Accessories such as sensors or batteries and the like may be used with products in a swimming pool that are either (1) operating in a high humidity environment such as: pumps engine rooms, chlorinators, chemical dosing apparatus, skimmers, showers, audio visual equipment, entertainment devices and the like; or (2) in a complete water submersion environment (underwater). Especially but not exclusively in a pool related platform such as submerged pool cleaning robot (PCR). The said attachments may be configured for multiple removals, reattachments or replacements.

BACKGROUND

It is well known that pool cleaning robots or pool robots that operate under water, may include a wide variety of electronically controlled sensor, sensors or multiple sensors bundled and packaged together, battery or batteries, a camera, other devices examples of which will be highlighted throughout this specification. The said including may be defined as an "add-on" that usually, due to the electronics involved, may include a permanent wiring-on i.e.: attachments or connections of the said add-ons by any mechanical means available such as screws, nuts, bolts, glues, wirings, ropes, cables, welding or soldering etc. The said inclusion may involve attachments onto the body or housing of the PCR, to its tethered cable, PCR handle or any subcomponent of the PCR system such a sealed motor compartment or a sealed motor unit.

On the one hand, there is a growing need to reduce product cost and construction costs of PCR. On the other hand, consumers, end users and the market ask for versatility and offerings to possess option to tailor-fit their PCR to suit their needs.

In response to such market demand, developments have concentrated on economical solutions to provide removable sensors, modules, cameras, batteries, other add-on removable devices and accessories, that may be fitted onto—and removed from (or replaced)—the on-board PCR and any of its subsystems.

Equally important is the fact that the add-on systems disclosed herein operate at low voltages and ampere levels that are safe to use under water. For example, an added-on removeable wireless (inductive or galvanic) battery connection ~18-23 V/~5 amps, a camera ~5-12 V/~0.5-3 amps and sensors ~4 V/~1 mA-20 mA It is therefore clear that permanent sensor or accessory attachments involve additional assembly and dismantling work, lack the flexibility to change or replace an accessory.

It is an object of this specification to provide economical, simple and safe solutions to this problem.

SUMMARY

There may be provided herein systems, methods and kits for providing removable and detachable add-on devices. The devices maybe electronically connected, allowing for their powering and for two-way data transmissions for use in underwater or highly humid environments. Each add-on device system may consist of a compartment divided into two sub sections: (a) the inductive power or electrical and data transferring or receiving side compartment (b) the functional add-on device compartment. Both sub section compartments are connected onto each other to create a unitary, water sealed add-on device that can be used to be removably attached onto a surface of a pool related platform such as pool cleaning robot, skimmer, buoy. This add-on device attaches and connects onto a separate power and/or data transmitting and/or receiving device that is permanently located and connected on or inside the pool related platform. Said permanent connection may be added as an after-sale product or installation kit.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
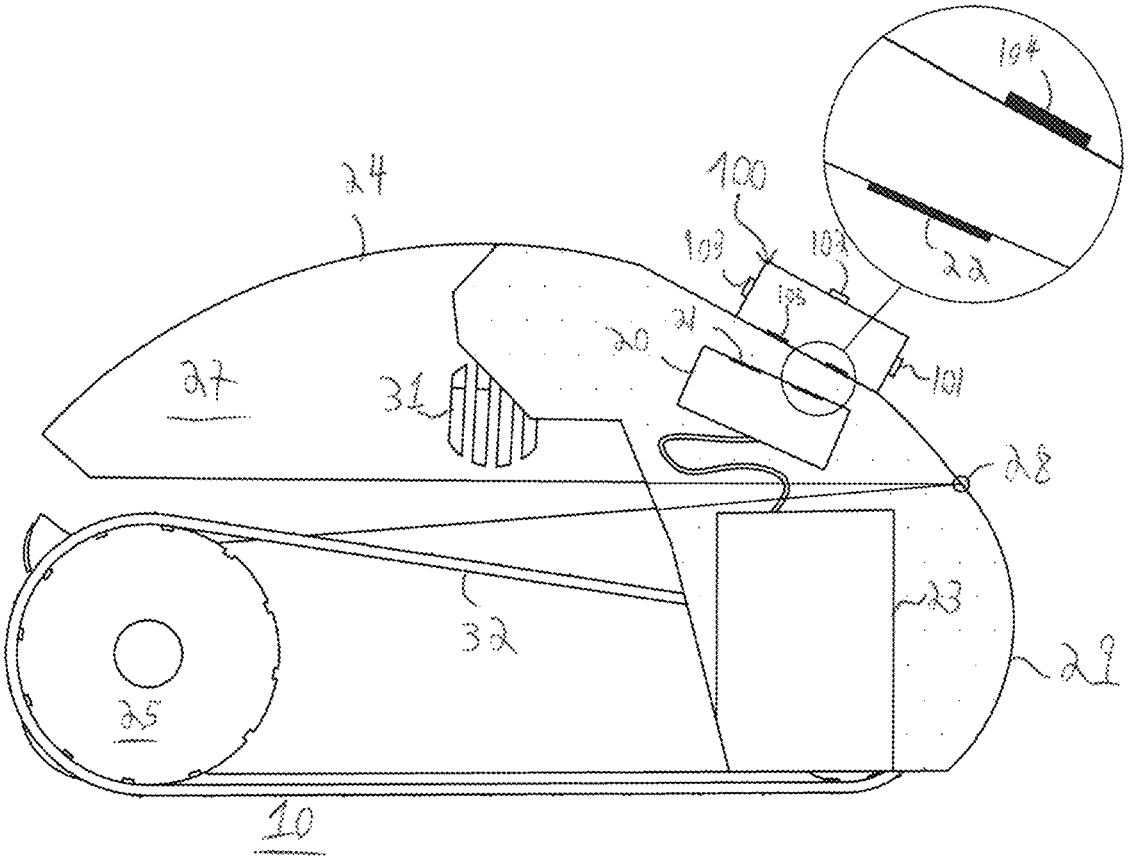
FIG. 1 depicts an example of a detachable diversified/multiplex sensor system of a pool cleaning system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF THE PREFERRED EMBODIMENTS

The following solution is applicable to a pool related platform (PRP). The PRP may be any platform that may perform an operation related to a fluid of a pool—cleaning, changing chemical composition, monitoring, and the like. Examples of a PRP include a pool robot that differs from a PCR, a PCR, a floating unit, a skimmer, and the like. Any example related a PCR may be applied mutatis mutandis, to any other PRP.

Any reference to a pool cleaner or pool cleaning robot, PCR or PRP should be applied, mutatis mutandis to a method that is executed by a pool cleaner and/or to a non-transitory computer readable medium that stores instructions that once executed by the pool cleaner will cause the pool cleaner to execute the method.

Any reference to method should be applied, mutatis mutandis to a pool cleaner or pool cleaning robot, PCR or PRP that is configured to execute the method and/or to a non-transitory computer readable medium that stores instructions that once executed by the pool cleaner will cause the pool cleaner to execute the method.

Any reference to a non-transitory computer readable medium should be applied, mutatis mutandis to a method that is executed by a pool cleaner or pool cleaning robot or PRP and/or a pool cleaner that is configured to execute the instructions stored in the non-transitory computer readable medium.

The term "and/or" is additionally or alternatively.

"Swimming pool" or "pool" mean any spa or tank or any reservoir containing liquid.

Because the apparatus implementing the present invention is, for the most part, composed of optical components, sensors and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

In the following specification, the invention will be described with reference to specific examples of embodiments of the invention. It will, however, be evident that various modifications and changes may be made therein without departing from the broader spirit and scope of the invention as set forth in the appended claims.

The word "may include" does not exclude the presence of other elements or steps then those listed in a claim. It is understood that the terms so used are interchangeable under appropriate circumstances such that the embodiments of the invention described herein are, for example, capable of operation in other orientations than those illustrated or otherwise described herein.

Referring to FIG. 1—there may be provided a pool related platform (PRP) such as a pool cleaning robot (PCR) 10 that may include a body 24 (that is illustrated as including an upper part 27 that is rotatably coupled (hinged, via axis 28) to a lower part 29, a detachable sensor unit (DSU) 100 that may include multiple sensors (for example first, second and third sensors 101, 102 and 103) and is detachably coupled to the body 24, and at least one power supply element (a battery, a cable fed supply unit, and the like). In FIG. 1 the power supply element is a wireless power transfer unit that includes a DSU wireless power interface (that include, for example DSU inductive coil 104) and a PCR wireless power interface 20 that is illustrated as including PCR inductive coil 22. In FIG. 1, DSU has a housing that includes multiple facets, and at least three sensors of the multiple sensors of the DSU are located in at least three different facets of the multiple facets. The housing of the DSU may be of any shape and may include linear and/or curved and/or other non-linear shaped parts.

The wireless power interface may be used for transferring power from one side (transmitter) to another (receiver). The power transfer may be from the PCR to the DSU and/or from the DSU to the PCR. The power transfer may include charging, and/or powering and/or communicating. The roles of the transmitter and receiver may change over time, or may be fixed.

A wireless power interface may include components other that the inductive coils. For example—a wireless power interface may include at least two components out of a capacitor that may form with the inductive coil an LC circuit, a driver for driving the LC circuit, a controller, a sensor, a load, a rectifier, a DC/DC converter, a communication receiving circuit, a communication transmitting circuit, and the like. For simplicity of explanation, various figures include the inductive coils and not all other components of the wireless power interfaces.

Referring to the sensors—the multiple sensors of the DSU may include at least one out of chemical sensors, environment sensors, radiation sensors, mechanical parameter sensors and drowning sensors. The multiple sensors may include at least one out of turbidity sensors, salinity sensors, chlorine level sensors, PH level sensors, ORP sensors, distance sensors, depth sensors, temperature sensors.

The multiple sensors may include at least one out of imaging sensors, underwater cameras, navigation cameras, depth cameras, constituents recognition cameras, dirty areas recognition sensors, navigation sensors, active sensors, passive sensors, compasses, magnetometers, gyroscopes, GPS based location sensors, inertial measurement sensors, acoustic sensors, pressure sensors, odometers, visual lasers, white light sensors, coloured light sensors, infra-red sensors, drowning recognition microphones.

The multiple sensors may include at least one water quality sensor.

FIG. 1 also illustrates various other PCR parts such as fluid outlet 31, track 32, brushing unit 25, motor unit and main control 23, and PCR magnet 21 that is magnetically coupled to DSU magnet 105—for magnetically attaching DSU 100 to PCR 10.

Figure 2:
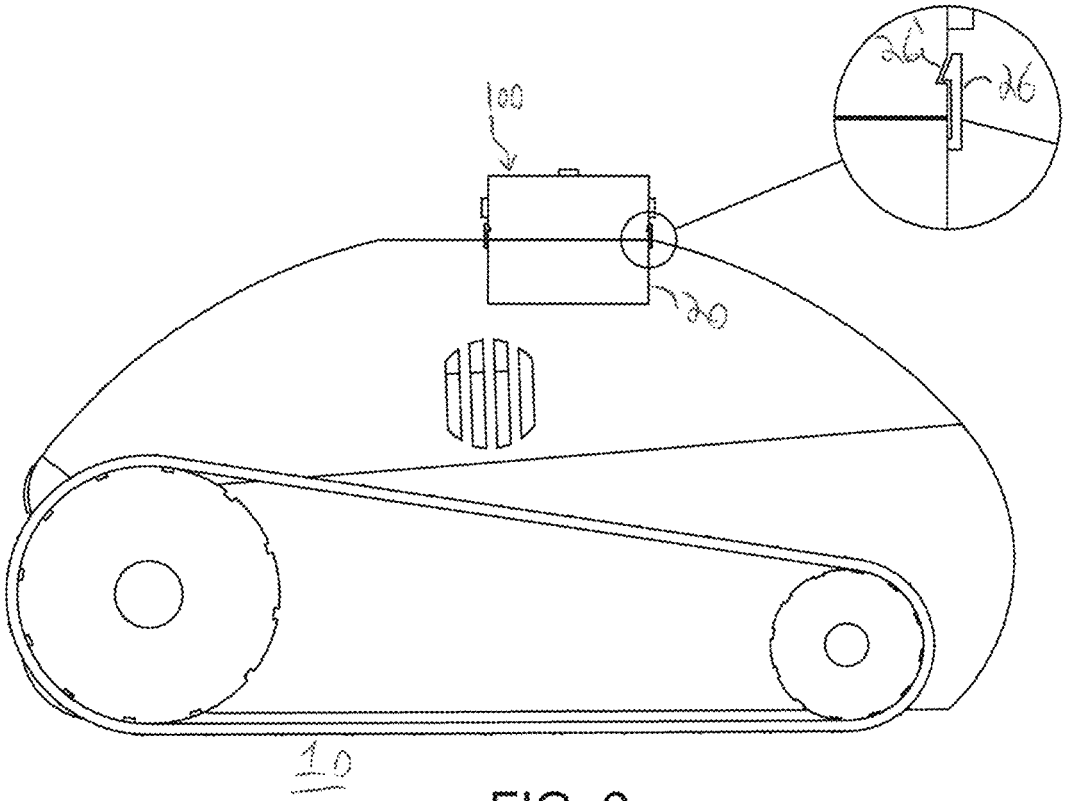
FIG. 2 depicts an example of an attachment of a detachable sensor of a pool cleaning system.

FIG. 2 illustrates PCR 10 and DSU 100 that are attached to each other by a mechanical attachment element—for example a movable hook 26 that is connected to the PCR 10 and fits a recess 26' of the DSU 100.

Figure 3:
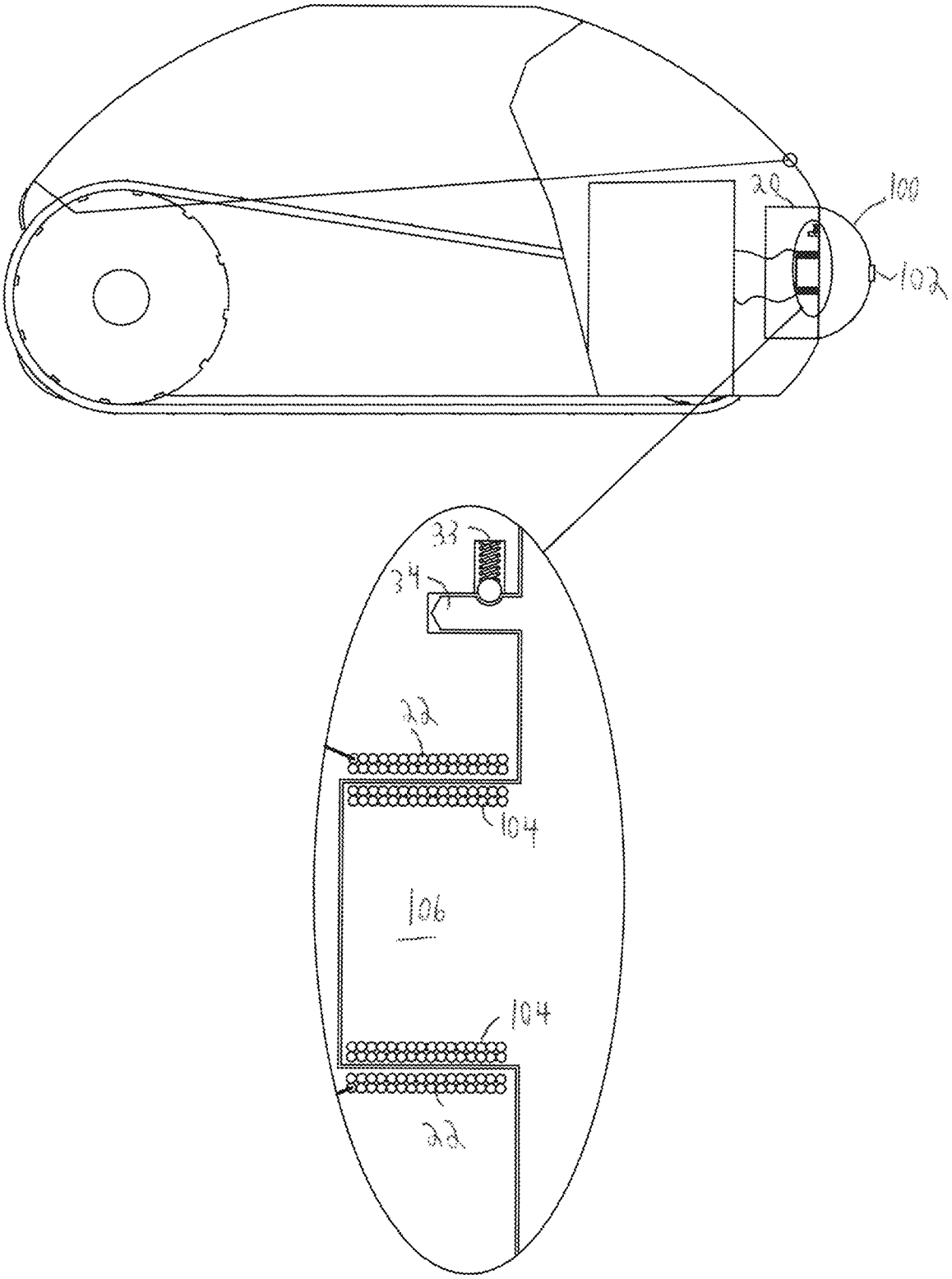
FIG. 3 depicts an example of an attachment of a detachable sensor of a pool cleaning system.

FIG. 3 illustrates two DSU inductive coils 104 are positioned in proximity to two PCR inductive coils 22—whereas the four inductive coils are parallel to each other and oriented to a vertical axis (not shown). The DSU includes a central protuberance 106 that fits a corresponding recess of the PCR, and an upper pin 34 that enters a upper recess of the PCR while a ball (or other interfacing element) is pressed against the upper pin 34 by spring 33. This figure shows sensor 102—although additional sensors may be provided.

Interface 20 or inductive coils 22 may be wired to motor unit and main control 23 for electrical and/or data transfer interface. Alternatively, for power only, interface 20 may contain a removeable, GP or rechargeable AA or AAA or 9V battery.

Figure 4:
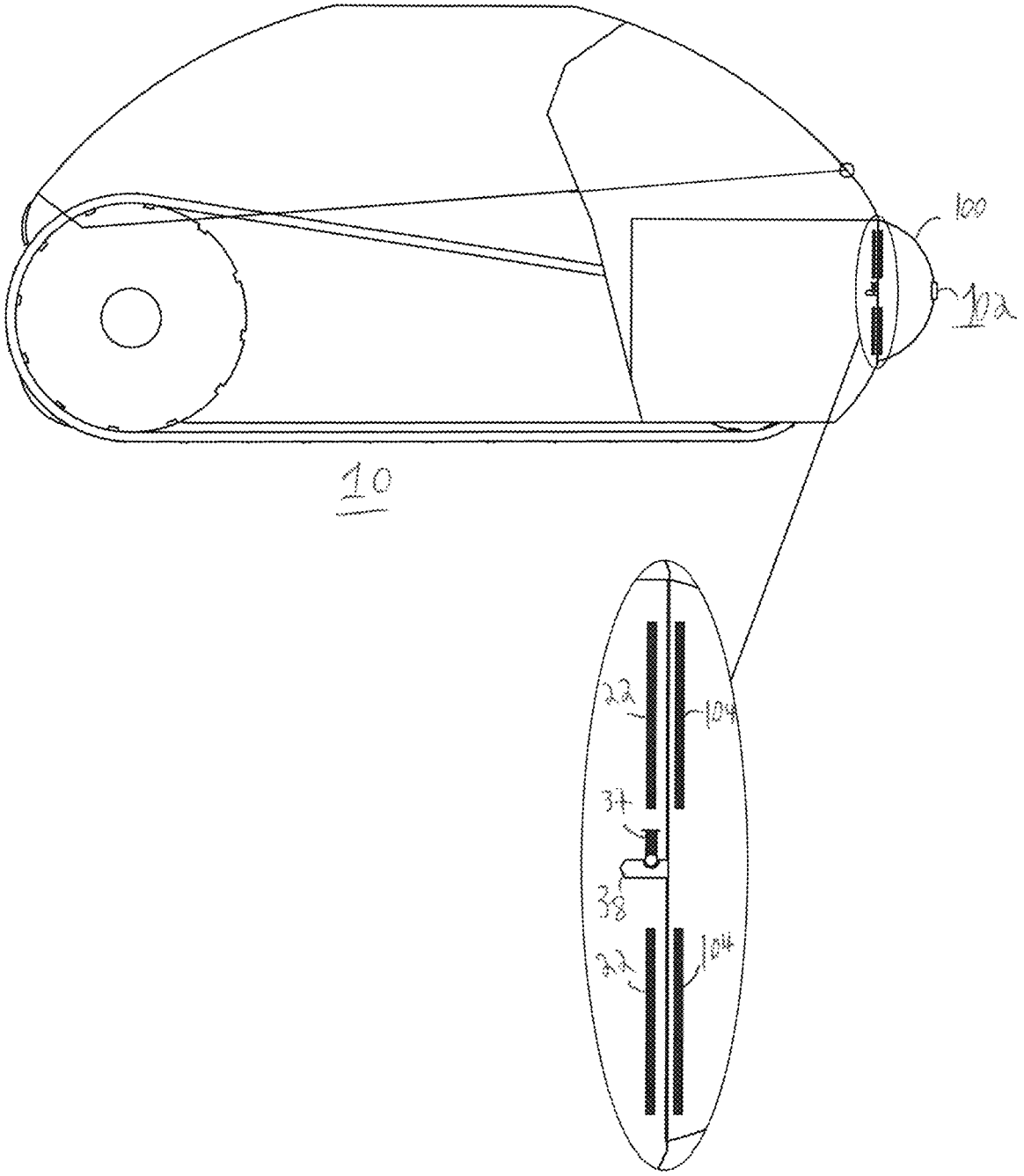
FIG. 4 depicts an example of an attachment of a detachable sensor of a pool cleaning system.

FIG. 4 illustrates two DSU inductive coils 104 are positioned in proximity to two PCR inductive coils 22—whereas the four inductive coils are parallel to each other and parallel to a vertical axis. The DSU includes a central pin 38 that enters a central recess 34 of the PCR while a ball (or other interfacing element) is pressed against the central pin 38 by spring 37. This figure shows sensor 102—although additional sensors may be provided.

In FIG. 4, inductive coil or coils 104 are located externally to motor unit and main control 23. PCR inductive coils 22 are located internally, on the inside of motor unit and main control 23. Sensor unit 100 is pressed through body 24 to contact the external sidewall of the motor unit to 'click' into position. Central pin 38 and spring 37 may be located elsewhere than depicted. For example, in at least one location against the lower part 29. This is an alternative for a direct LC circuit contact that forsakes any additional electrical or data wiring.

Figure 5:
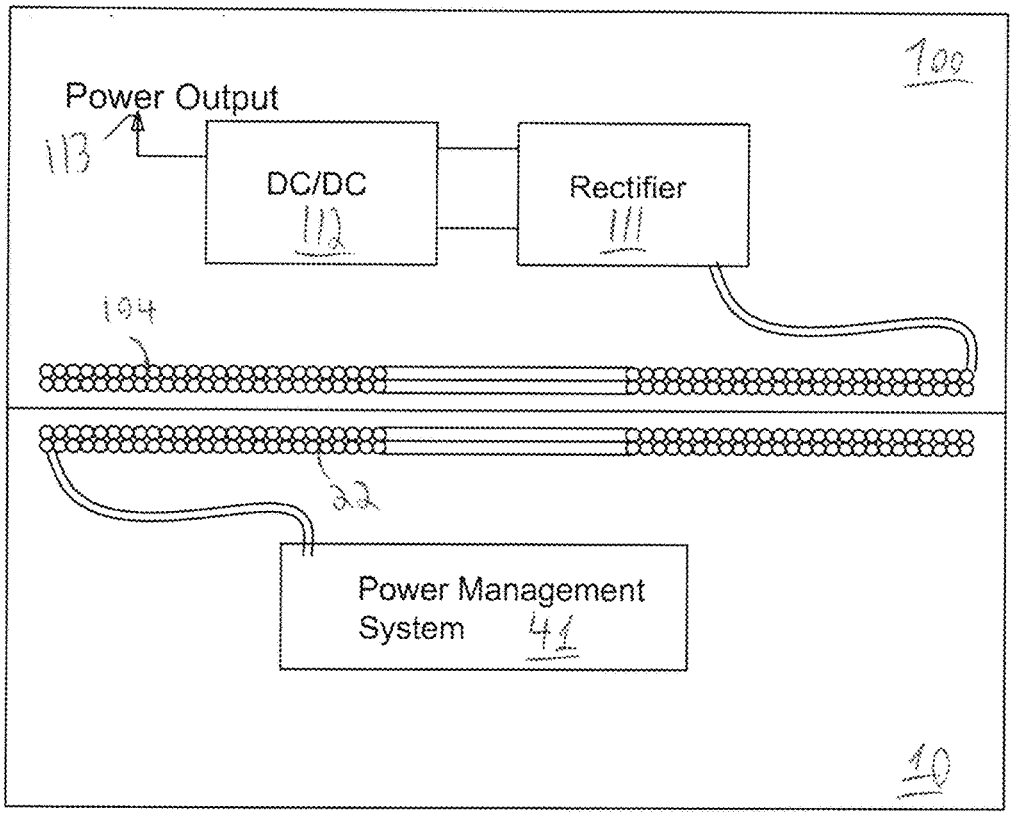
FIG. 5 depicts an example of an internal arrangement of a detachable sensor of a pool cleaning system.
Figure 6:
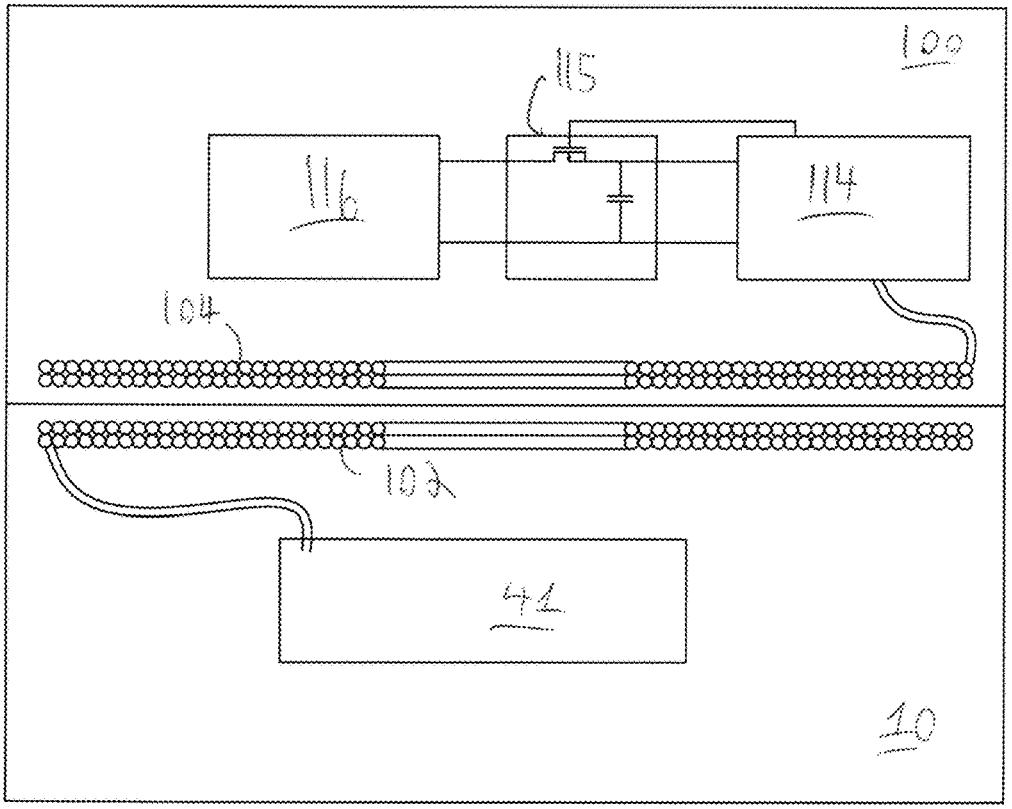
FIG. 6 depicts an example of an internal arrangement of a detachable sensor of a pool cleaning system.

FIGS. 5-6 illustrate two example of the wireless power interfaces that include one or more DSU inductive coils 104 are positioned in proximity to one or more PCR inductive coils 22.

In FIG. 5 the one or more DSU inductive coils 104 are in power communication with rectifier 111 that is followed by DC/DC converter 112 that outputs power to various parts of the DSU via power output 113. The one or more PCR inductive coils 22 may be in power communication with PCR power management system 41.

In FIG. 6 the DSU inductive coils 102 may be in power communication with units 114, 115 and 116.

Figure 7:
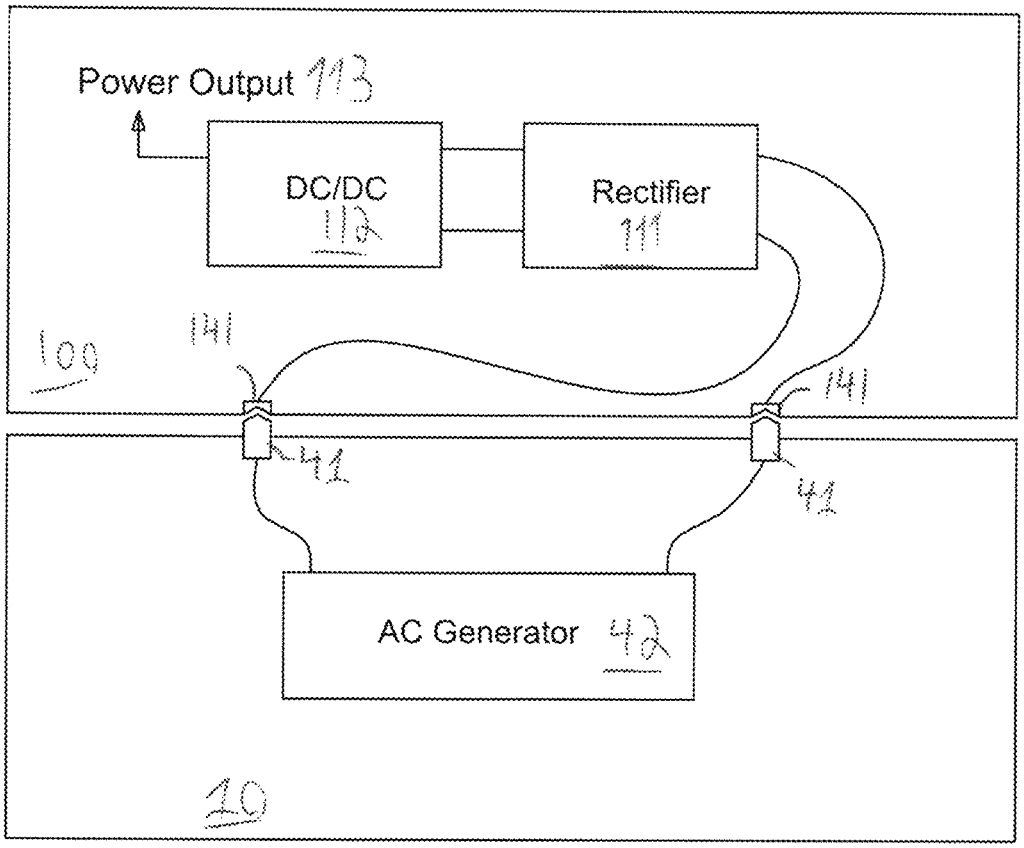
FIG. 7 depicts an example of an internal arrangement of a detachable sensor of a pool cleaning system.

FIG. 7 illustrates that the PCR 10 and the DSU 10 interface using a wired (galvanic connection) interface—AC generator 10 is coupled to PCR wired interfaces 41—that are in contact with DSU wired interfaces 141. The DSU wired interfaces are in power communication with rectifier 111 that is followed by DC/DC converter 112 that outputs power to various parts of the DSU via power output 113

The PRP may include at least one rotating unit that is configured to introduce a rotational movement between at least one sensor of the DSU and the body. The rotation may change the field of view of the at least one sensor to cover a region of interest. The at least one rotating unit may be configured introduce the rotational movement about an axis of rotation or about multiple axes of rotation. The rotational movement may include a change in a roll angle and/or a pitch angle and/or a yaw angle. The at least one rotating unit may be configured introduce a rotational movement between the DSU and the body. The DSU may be rotated and/or the body may be rotated. A sensor may be rotated in relation to the DSU instead or in addition to a rotation of the DSU and/or body.

Figure 8A:
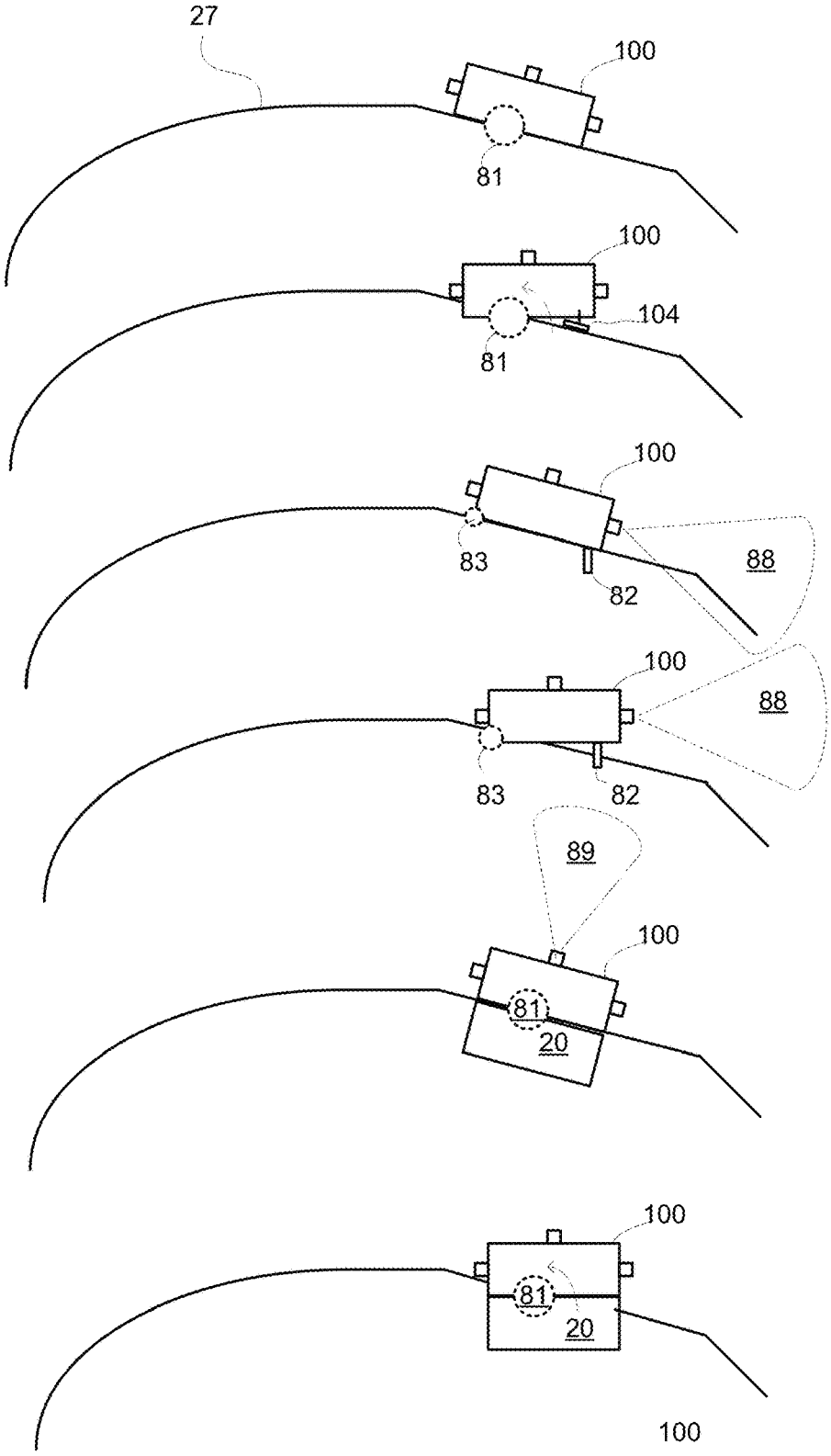
FIG. 8A illustrates examples of PCR and a detachable sensor unit.
Figure 8B:
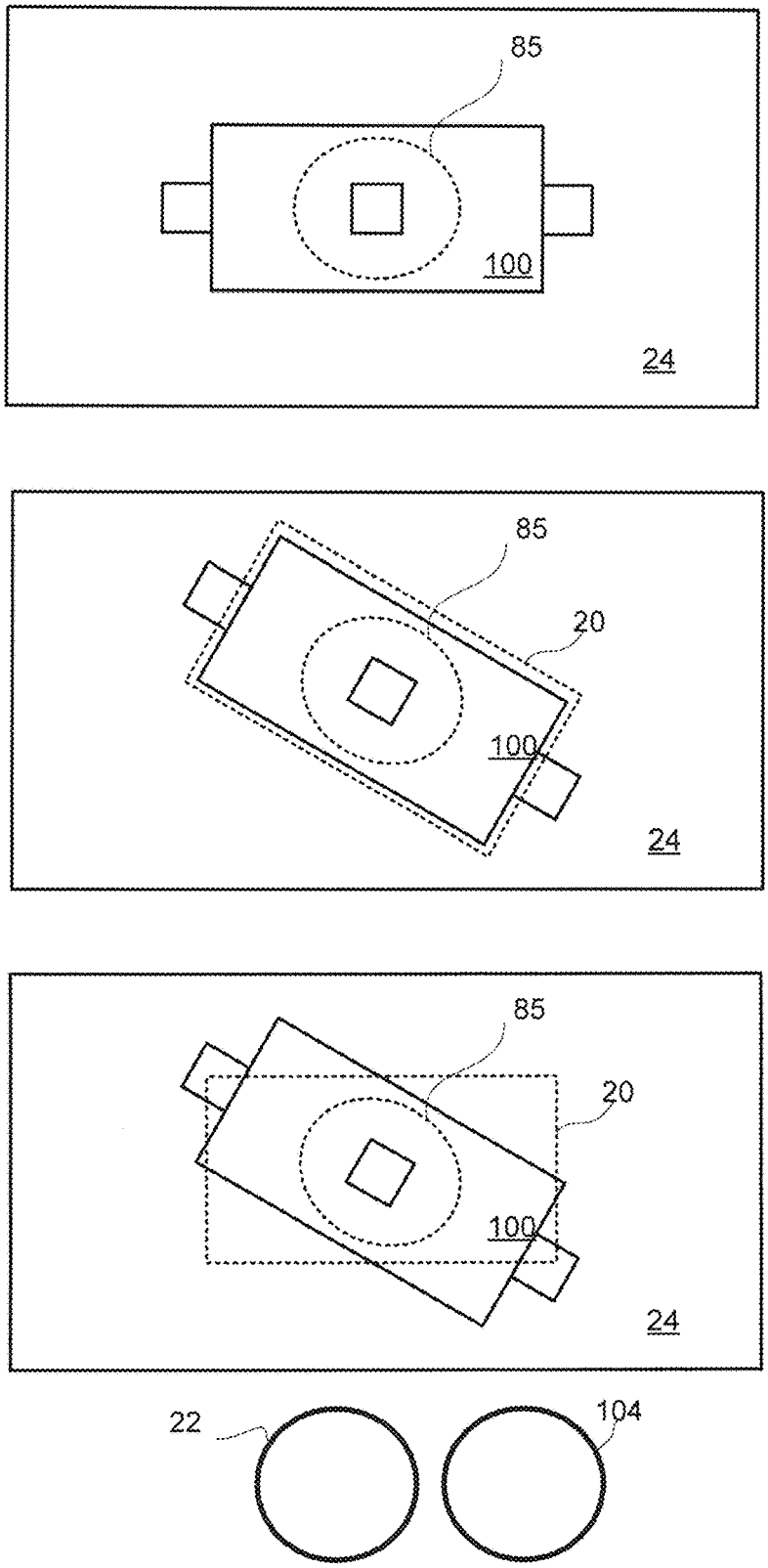
FIG. 8B illustrates examples of PCR and a detachable sensor unit.

FIGS. 8A and 8B provide examples of DSU 100, an upper part 27 of the PCR, and various rotating units—pitch angle rotating unit 81 of FIG. 8A, rotating unit 82 and rotation axis 83 of FIG. 8A, and yaw angle rotating unit 85 of FIG. 8B.

In order to maintain proximity between the PCR wireless power interface 20 and the DSU wireless power interface—despite change in the pitch angle—the PCR wireless power interface 20 may also be rotated by pitch angle rotating unit 81—in order to follow the movements of the DSU. It should be noted that instead of rotating the PCR wireless power interface 20—the DSU inductive coil 104 may maintain in close proximity to the PCR inductive coil 22—for example by using an interface that allows the DSU inductive coil 104 to extend below the DSU 100.

In order to maintain proximity between the PCR wireless power interface 20 and the DSU wireless power interface—despite change in the yaw angle—the PCR wireless power interface 20 may also be rotated by yaw angle rotating unit 85—in order to follow the movements of the DSU. Alternatively—the PCR inductive coil 22 and the DSU inductive coil 104 may have a rotational symmetry—for example may have an annular shape or a circular shape—and the rotation of the DSU may not require to rotate the PCR wireless power interface 20.

FIG. 8A also illustrates example of fields of view 88 and 89 of two sensors of the DSU.

At least two of the multiple sensors may be the same or may differ from each other by type. For example—the type may be selected out of a visual sensor and a non-visual sensor.

A field of view of one of the multiple sensors is oriented to a field of view of another sensor of the multiple sensors. Alternatively—the fields of view are not oriented to each other. The field of view may differ from each other by any parameter (size, shape, orientation, direction of optical axis, and the like) and/or may have one or more same parameter.

Figure 8C:
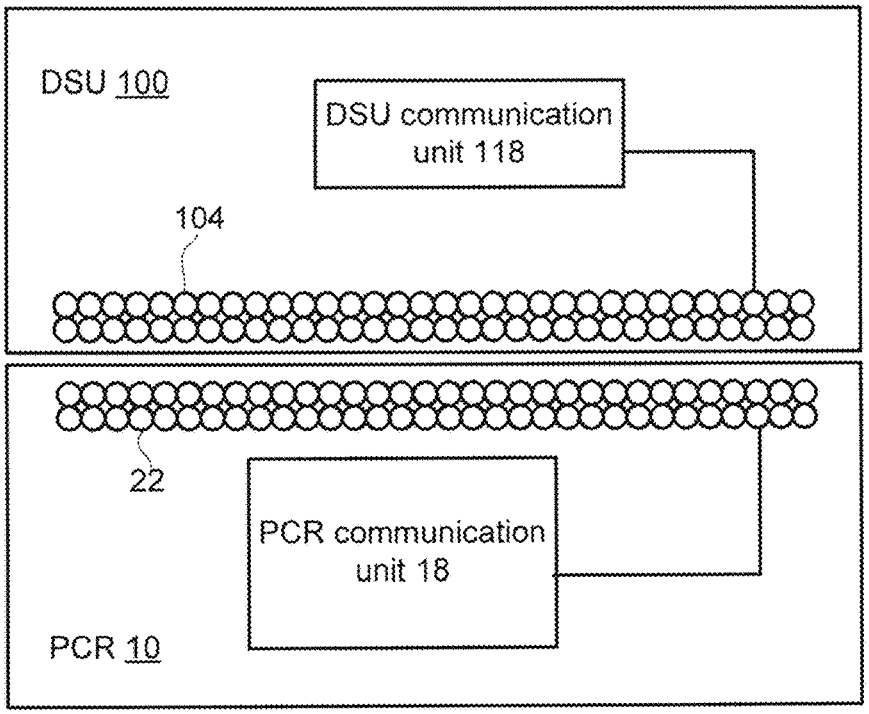
FIG. 8C illustrates examples of wireless communication units.
Figure 8C:
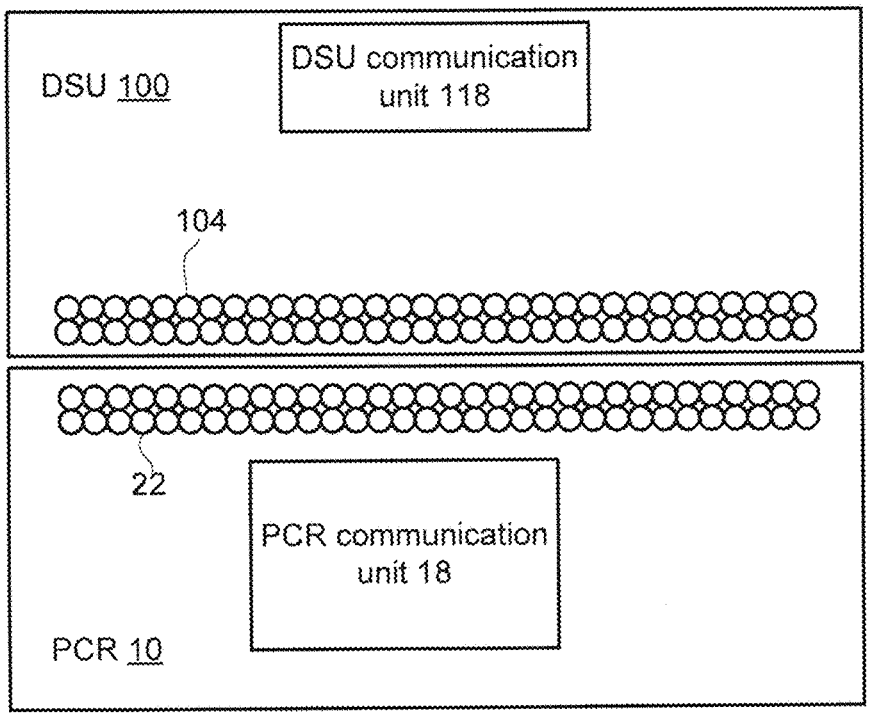

FIG. 8C illustrates a DSU 100 and a PCR 10 that have a DSU communication unit 118 and a PCR communication unit 18 respectively, that may wirelessly communicate—either using PCR inductive coil 22 and the DSU inductive coil 104 or without using PCR inductive coil 22 and the DSU inductive coil 104.

Additionally or alternatively, the communication units may communicate via wire.

The DSU may include a DSU wireless communication unit that is configured to preform wireless communication with a wireless communication unit of the body.

The DSU may include a DSU wire-based communication unit that is configured to perform wire-based communication with a wired communication unit of the body.

The pool related platform may include at least one additional DSU.

The pool related platform may include at least one non-detachable sensing unit.

Figure 9A:
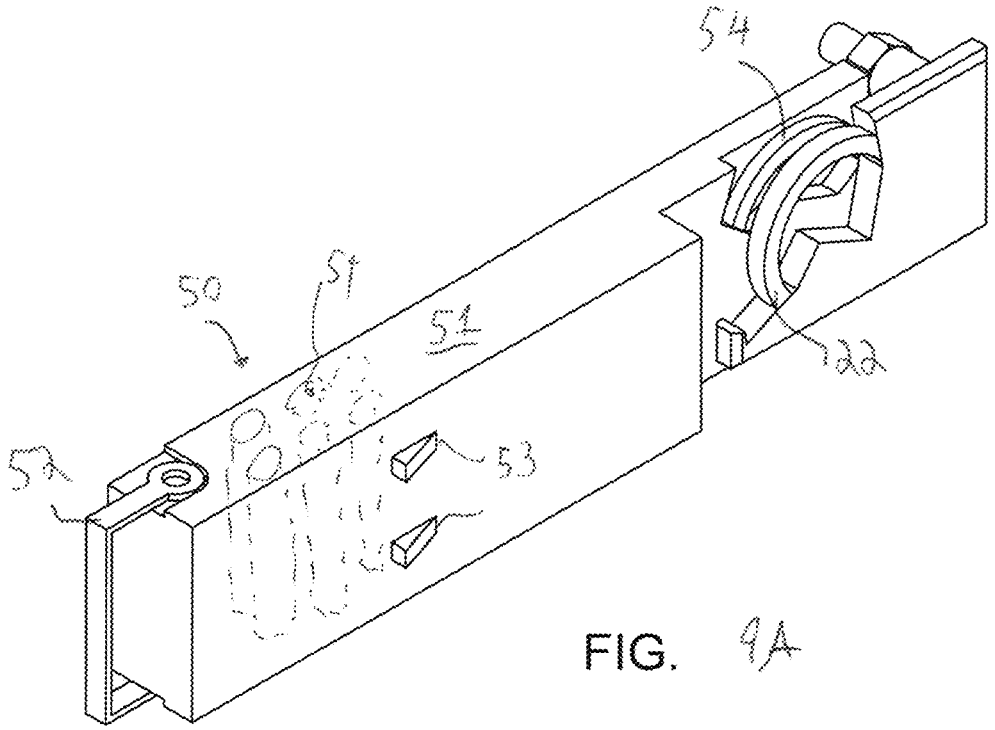
FIG. 9A depicts an example of a partly exploded view of a detachable battery of a pool cleaning system.

FIG. 9A provides an example of a detachable power source (DPS) 50 that includes DPS housing 51, one or more batteries 59 and a DPS wireless power interface that may include a DPS inductive coil 54. The DPS inductive coil 54 is proximate to and faces PCR inductive coil 22.

The body of the PCR may include an inner space for receiving the DPS. The inner space may be located in any location within the PCR that can provide enough space to receive the DPS. It may be beneficial that the inner space ends with an opening (that can be selectively closed) that is formed in the housing of the PCR—to enable an easy retrieval of the DPS. When the PCR has two parts or a cover or other parts of the housing that is removable and/or detachable—then the opening may be formed at any part of the PCR that is exposed once the two parts or cover are opened or removed, and the like.

For example—a PCR may include a motor housing that surrounds one or more motors and the control of the pool related platform, and the inner space may be defined at least in part by a sidewall of the motor housing.

FIG. 9A illustrates the DPS 50 as including a handle 52 that can be used to extract the DPS 50 from the PCR or to insert the DPS 50 into the PCR. The DPS 50 may also include fastening elements 53 such as clips, springs, movable elements, and the like—for securing the DPS to the in er space of the PCR and to align inductive coils 54 and 22.

FIGS. 9B, 10, 11, 12, 13, illustrate examples of PCR 10 that includes a detachable power source (DPS) 50. The PCR 10 includes filtering unit 62, motor unit housing 63 (that surrounds a motor unit and may also surround one or more other components).

Figure 9B:
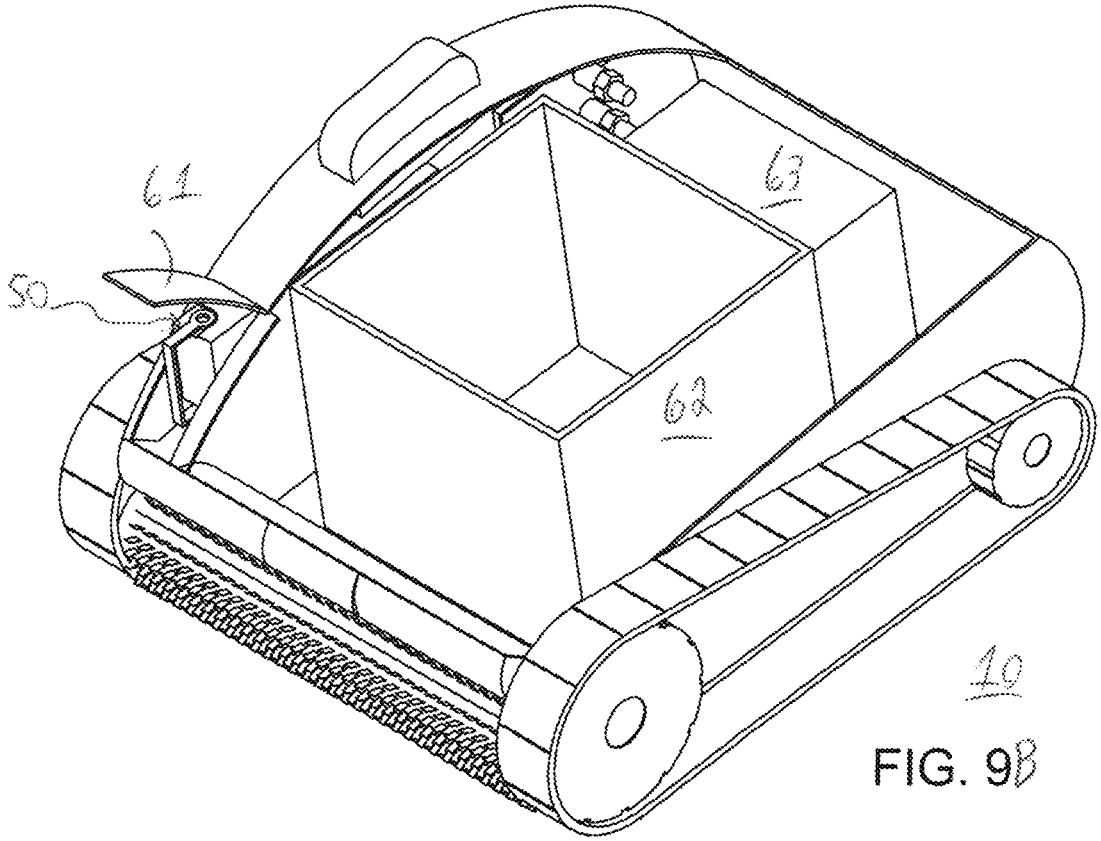
FIG. 9B depicts an example of a partly exploded view an inserted detachable battery of a pool cleaning system.

FIG. 9B illustrates the inner space (in which the DPS 50 is located) that is located to the right of the filtering unit, whereas the inner space is closed by a hinged cover 61. The hinged cover may seal the inner space.

Figure 10:
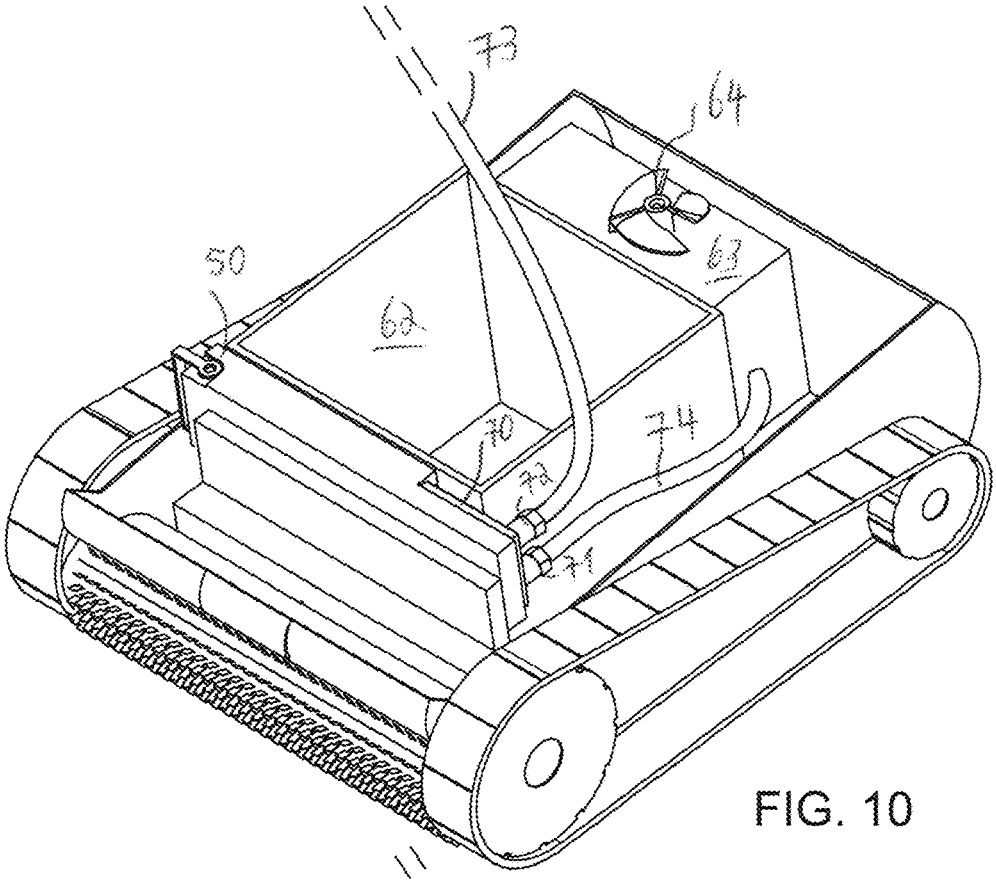
FIG. 10 depicts an example of an inserted detachable battery of a pool cleaning system.
Figure 11:
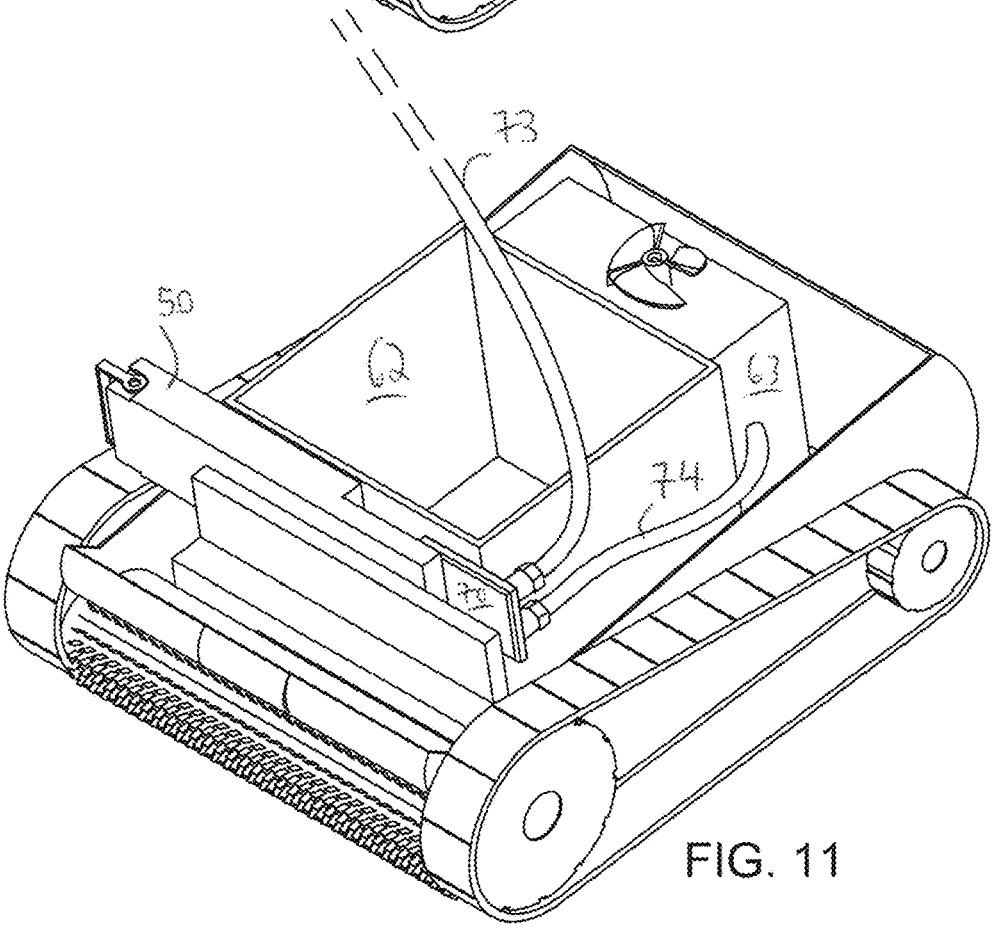
FIG. 11 depicts an example of a removal of a detachable battery of a pool cleaning system.

FIGS. 10 and 11 illustrate the inner space located in front of the filtering unit 62. In addition, the PCR includes a PCR power distribution unit 70 that includes a PCR wireless power transfer interface that includes a PCR inductive coil (shown in 54 and 22 in FIG. 9A) that faces a DSP wireless power transfer interface that includes (i) a DPS inductive coil, (ii) a controller, (iii) a first connector 71 connected to a first power and data cable 74 that feeds a drive motor, pump and control (located within motor unit housing 63) that rotates impeller 64, and (iv) second connector 72 that is connected to cable 73 (for power and/or communication from an external power source). In FIG. 10 the DPS is fully inserted in the inner space while in FIG. 11 the DPS is partially located within the inner space.

It should be noted that power may be transferred from the cable 73 to the DPS (for example when charging the DPS), or may be transferred from the DPS to power consuming elements of the PCR—such as motor unit. The power may be transferred from the cable to the power consuming elements of the PCR.

The controller of the PCR power distribution unit 70 and/or the control unit in the motor unit are configured to control the transfer of power.

Figure 12:
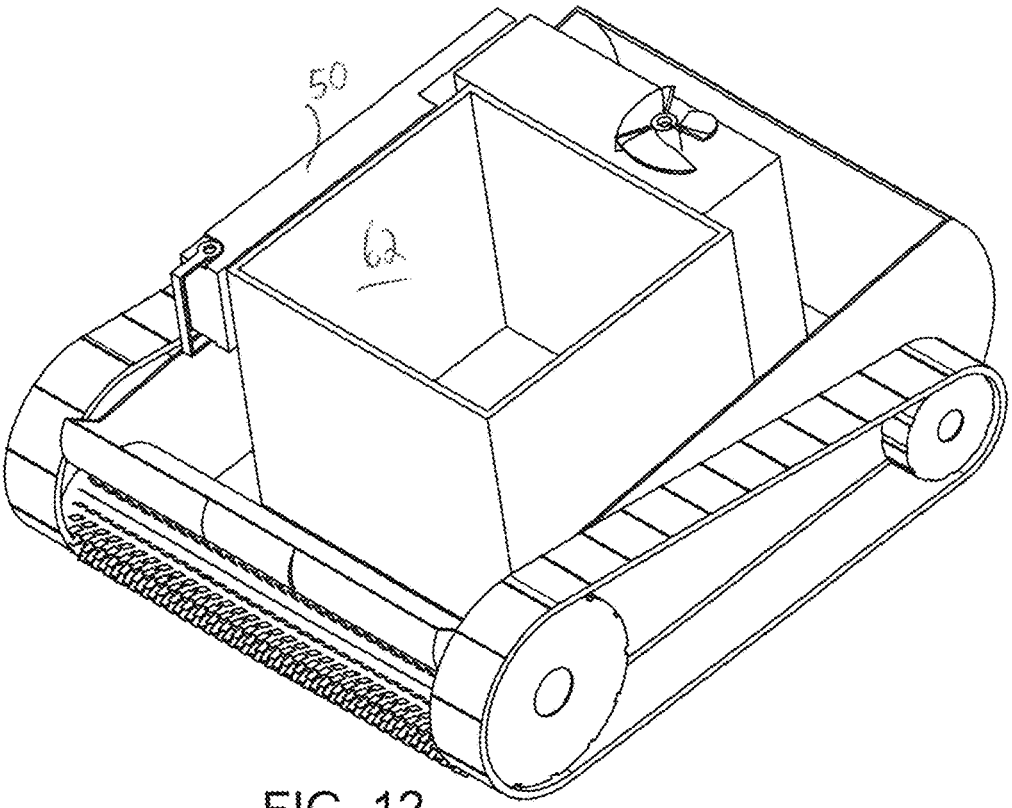
FIG. 12 depicts an example of an inserted detachable battery of a pool cleaning system.
Figure 13:
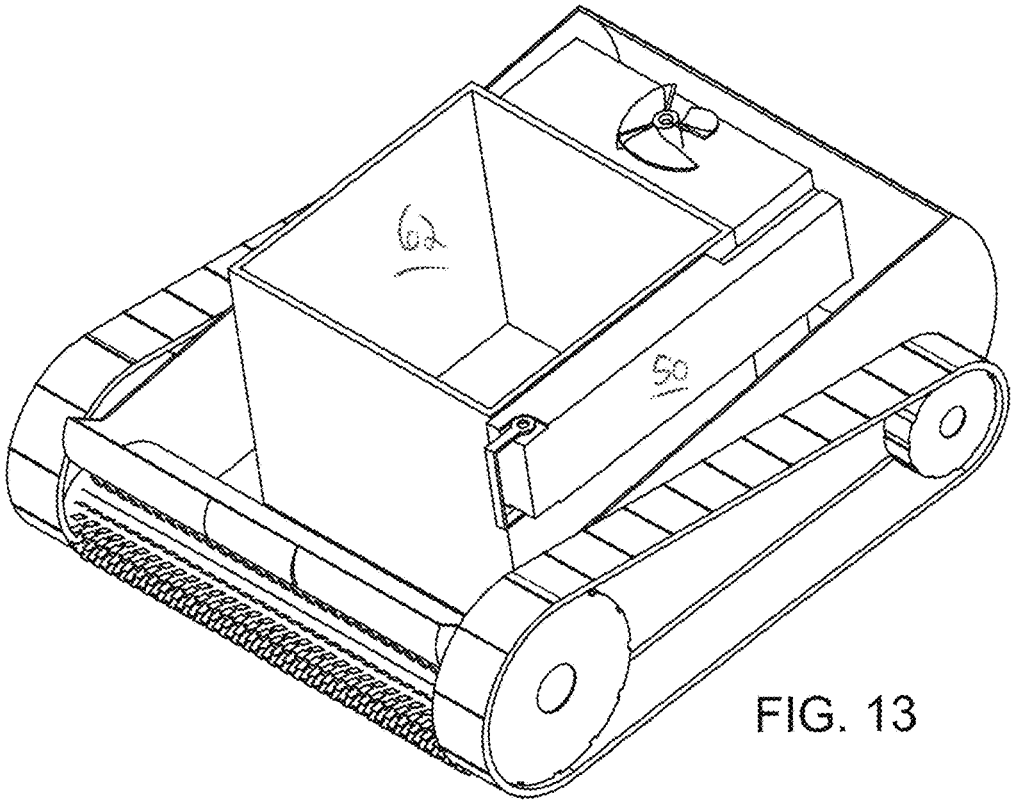
FIG. 13 depicts an example of an inserted detachable battery of a pool cleaning system.

FIGS. 12 and 13 illustrate DPS located to the right of the filtering unit 62 and to the left of the filtering unit. It should be noted that the PCR may be configured to store both DPSs—and may even store a DPS on one side of the filtering unit and a dummy DPS on the opposite side of the filtering unit. The dummy DPS may have the same weight as the DPS—and is used to balance the PCR.

It should be further noted that FIGS. 12 and 13 illustrate examples of DPS that do not have any previous cable or wiring connections (73 or 74) to either a power and/or communication from an external power source, nor to a motor unit. These are examples of a battery/ies that are manually removeable and detachable for recharging externally to the pool. When reinserted the battery directly aligns, connects so that the inductive coil 22 and the inductive coil 54—that is located internally, on the inside of motor unit and main control 23—snugly 'click' into positions.

Figure 14:
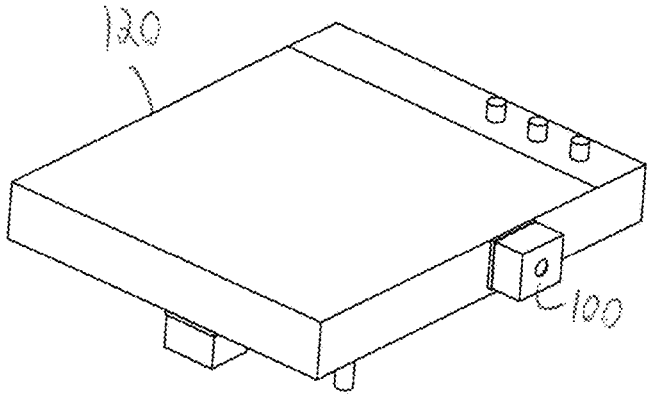
FIG. 14 depicts an example of a detachable sensor of a float of a pool cleaning system.
Figure 15:
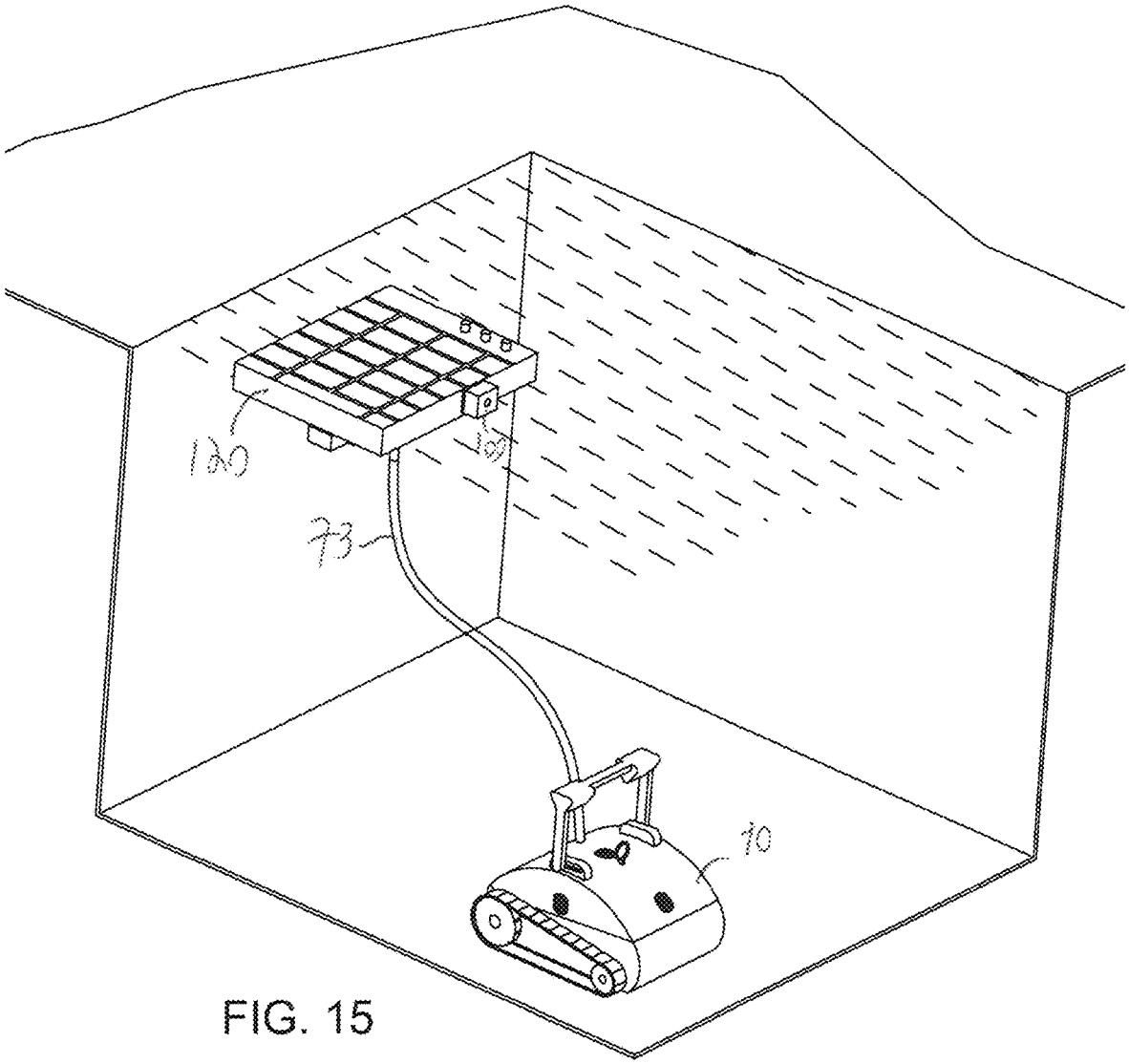
FIG. 15 depicts an example of a detachable sensor of a solar float of a pool cleaning system.

FIGS. 14 and 15 illustrate two examples of DSU 100 that are detachably attached to a floating unit 120 (one facing horizontally and the second vertically downward). In FIG. 15 a PCR 10 is coupled to the floating unit and charging solar panel via cable 73.

Figure 16:
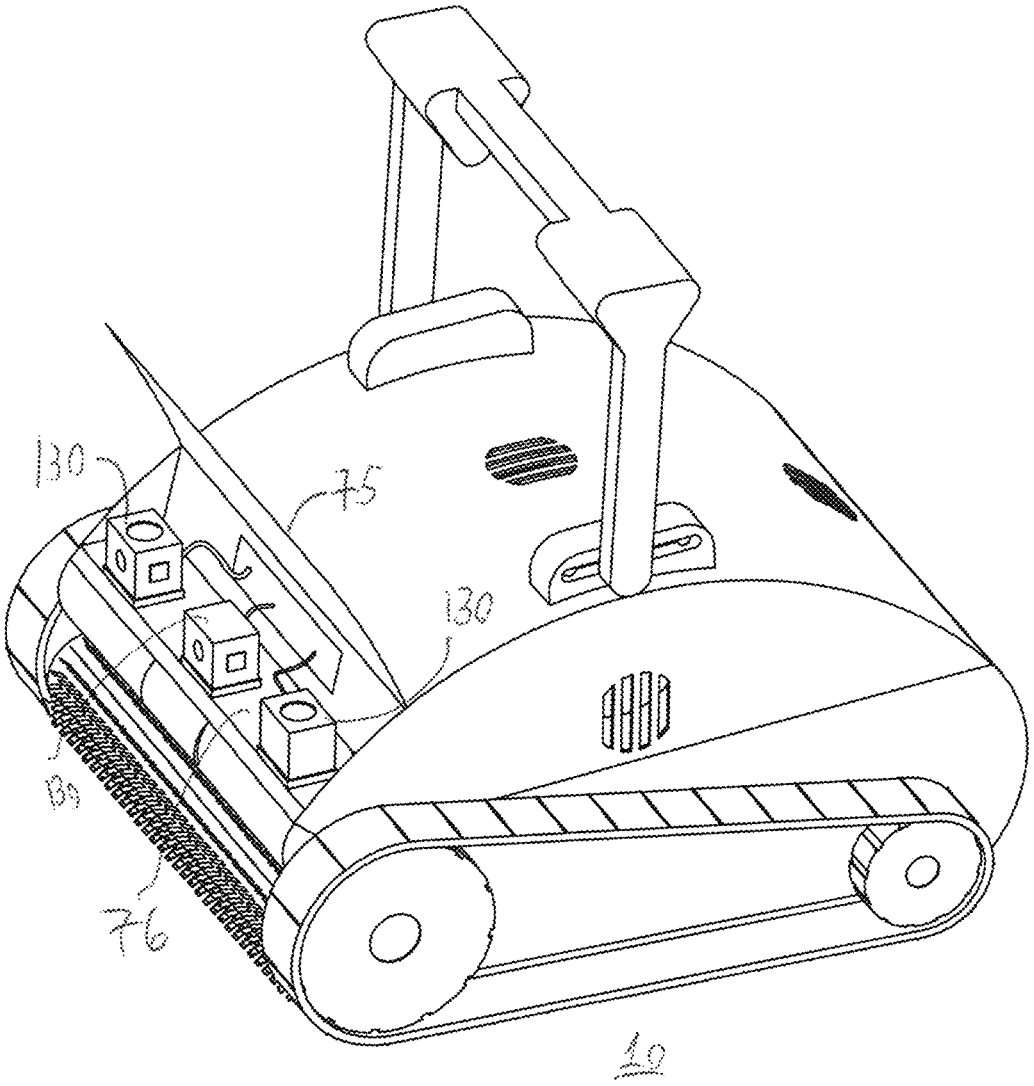
FIG. 16 depicts an example of separate assorted detachable sensors of a pool cleaning system.

FIG. 16 illustrates an example of a PCR that has a hinged cover 75 that selectively closed an inner space formed above a plane 76 located above the cleaning brush 130. Multiple DSUs are located within the inner space—for example three DSUs 130.

Figure 17:
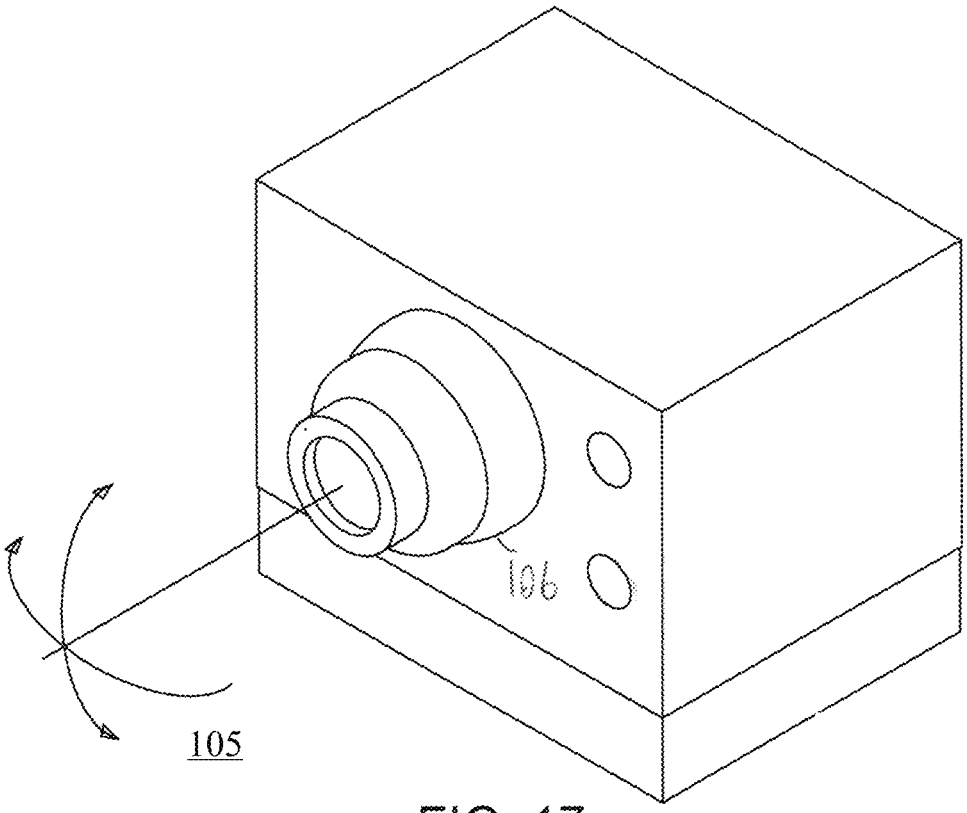
FIG. 17 depicts an example of a detachable optical device of a pool cleaning system.

FIG. 17 illustrates a sensor 105 of the DSU that is a camera that has a driver whereas the camera lens may zoom and may move about two axes.

Figure 18:
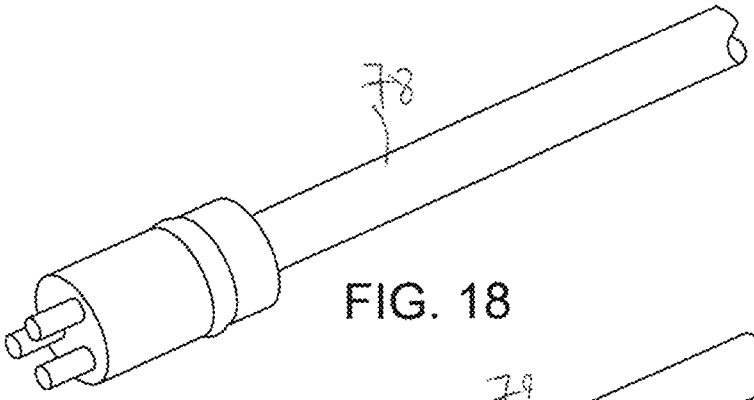
FIG. 18 depicts an example of a cable and cable connection of a detachable battery of a pool cleaning system.
Figure 19:
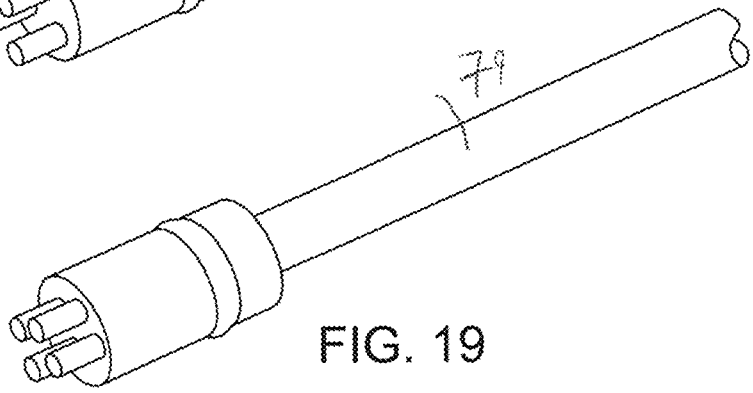
FIG. 19 depicts an example of a cable and cable connection of a detachable battery of a pool cleaning system.

FIGS. 18 and 19 illustrate examples of two power and data cables 78 and 79.

It should be noted that data transfer signals may also be transferred wirelessly in parallel to power transfers, to or from a pool related platform, to or from any added-on device or accessory.

In induction power and data transfers there are at least two basic two participants: a transmitter (TX) and a receiver (RX) that are suited for underwater applications in general and specifically for submerged pool related platform (PRP) in private homes or public swimming pools. By definition, power transfers—including induction—begin with a power transmission to the power receiver but in this specification, the transfers between TX and RX may be power and communications transfers in opposite directions. Namely, from a nominally defined TX to an RX and from a nominally defined RX to a TX.

This means that in some applications the transmitter and receiver functions may alternate. Namely, the RX and the TX may perform alternately for example: electrical power may be transmitted or flow from a power supply source (power supply source, transformer or battery)—in a first direction—to a load device or an accessory that receives said power. For example: a battery power source (TX) may power a sensor. That same battery may also be inductively charged while on-board the PRP when being charged from an external power transmitter. So, the TX will alter its function and will be defined as an RX for the purpose of charging a battery.

Data may also be transmitted between a TX and an RX. A (receiver) sensor such as a camera, may receive both (a) power to operate and (b) operating commands from a central electronic control management such as: to switch-on, to optically scan environment and then alternate a function by transmitting back any captured optical data. Data flows from the TX to the RX and back from the RX to the TX.

Because in this specification the power and/or data may flow in both ways (TX to RX and back), the terminology of RX or TX is alternate in the sense that the electrical and data flows may alternate i.e.: inverse their flow directions; this may be related to the actual and specific process occurring in this two-way flow process.

At least one of a TX and/or RX may be permanently located or attached onto the PRP transmitting power and/or data to a removeable added-on TX or RX accessory that may be detachably connected onto the pool related platform. Either a TX and/or RX in this specification may be removeable and therefore temporary. In the case of upgrading a product, both TX and RX (sensor and/or driver) may be retrofitted post sales by means of connections of upgrade TX and/or RX kits.

When the said add-on device TX and/or RX are connected to one another the connection may be configured to be a magnetic connection or a mechanical connection, for example: a pressure fitting, spring plunger, clip or any pressure insertion and securing mechanism allowing quick release, removal or detachment and reattachment of the said add-on accessory.

The add-on accessory device may be removeable, detachable or replaceable. Either TX/RX driver device may be universally suited to interchangeably accept a variety of add-ons each time. It allows to remove the one add-on and attach another in the same location or locations.

Multiple such said fittings may be placed on the external surface of the PRP or in its internal housing as preparations or as a post-sale kit installation to accept one or more add-on devices.

The add-on device may be configured to contain multiple sensors (may be arranged as an array or as a multiplex in one box or accessory packaging. For example, a single such multi-sensor may contain a camera, navigation sensor (namely GPS, gyro . . . ), water quality sensors, a lighting fixture, a distance range finder device, an acoustic transducer, a microphone and the like.

The said multiple sensors may be bundled or packaged together according to functionalities: The multiple sensors may be located in any location in relation to the PCR—front of the PCR, back of the PCR, size of the PCR, bottom of the PCR, top of the PCR, and the like. Different sensors may be located at different locations.

There may be provided a device that is configured to connect to a related platform. The device is preferably an added-on sensor box that includes at least one sensor or accessory that may be detachable and removable from the housing of the pool related platform. In some preferred embodiments the device may include: a central inductive two-way power and/or data flow between the TX and/or the RX of the sensor box; a computerized control unit; where the control unit includes an automatic connection discovery of the new box and the at least one sensor or accessory when the boxes' TX and RX and drivers are connected; applying specific commands and control for the sensor box and for each of the at least one sensor or accessory. There may be provided an automatic turn-on of the PRP by attachment of the RX to the TX (sensor or accessory). This may be particularly beneficial when connecting a newly charged battery that will be discussed further-on.

The said at least one sensor or accessory box may include multiple sensors each responsible for a different task. A multiple sensor box may group sensors or accessories that may be defined to be used to perform similar tasks. For example, some of the sensors or accessories relevant to a swimming pool environment that may be used, are to recognize the following: turbidity, salinity, chlorine level, PH level, ORP, distance—ultrasonic ToF, distance-optical ToF, distance—optical geometry, depth, temperature; Or, to employ: imaging sensor, underwater camera, navigation camera, 3D camera, constituents recognition camera, dirty areas recognition, navigation/laser range finder, compass, magnetometer, gyro, GPS, inertial measurement/IMU, acoustic sensor, pressure sensor, odometry, visual laser, white light, coloured light, infra-red light, drowning recognition microphone, a wireless communication module that includes a Wi-Fi® or a Bluetooth® device, an antenna and a communication PCB.

Data may be transmitted to the said end user who may authorize storing the data in the cloud or on an internet server for future reference.

It is advantageous to combine one multiple pool navigation sensor box that includes a package of, for example, a camera, an acoustic distance sensor, a lighting outlet LED lamp and the like. Such a said dedicated multi-sensor box may be OEM installed or it may be marketed post sale to interested end users.

Such a said multiple navigation sensor box package or multiplex may therefore also include a motor or servo motor to rotate the seated sensors in the horizontal axis so that the sensor needed by the control box for a specific navigation task (for example, a first acoustic sensor), may be positioned, aimed or aligned with the trajectory of the PRP or with data requirement relevant to the actual or planned trajectory of the pool related platform. After the first sensor has acquired the aid navigational data which was stored in the said motor unit control, a second sensor (for example a camera) may be rotated to be in-line with the trajectory of the PRP or with data requirements relevant to the actual an/or planned trajectory of the pool related platform.

The PCR may include a DPU that includes a multiple sensor box and cover that includes multiple sensors or accessories; said box is attached, in an exemplary manner, to the external surface of the PCR lid. The said sensor box is depicted to have a flat bottom section is connected to a sensor driver box that has its flat section attached onto the internal surface of that said PCR lid. The box and the driver may remain attached by means of, for example, a magnetic connection attached onto the driver box that may be magnetically drawn to a matching metal. The driver box is electrically wired using a wiring connection to the motor unit that includes a main controller which may be an electronics PCB and a computerized processor. The box may be manually pulled away or detached/removed off the PCR lid. The sensor driver box may remain attached to the inside chassis of the PCR housing even when the hinged lid is opened and the sensor box is detached from the sensor driver. When the lid is closed again, the sensor and driver reconnect. See, for example, FIG. 1.

The multiple sensor box may contain a single sensor only where each of the sensors' or added-on accessory function is to either collect data within the pool environment or to perform a different task such as emitting light. Data transfer is a two-way flow to initiate data collection or a task, to control, to process and store collected data in the main control system of the motor unit. Electrical powering of the sensor box electronic PCB and the sensor functions originates from the electromagnetic energy power distribution within the motor unit which in turn may receive this power from by means of a tethered cable and wiring system from an external power supply or a battery.

Examples of the inductive power rating ranges in this entire specification for added on sensors or accessories is 4V, 1 mA-20 mA. Added-on camera accessory is 5V-12V, 0.5 A-3 A. Added-on battery is 18V-23V, 5 A The data and power are transferred between the transmitter (TX) to the receiver (RX) using parallel and aligned inductive coil arrangements that consist of each a first and a second half-core coil winding assemblies. Both TX and RX are aligned into mating and abutting proximity between said first and second half-core coil winding thereby providing a magnetic coupling path that may be connected to a load device.

The electromagnetic transfer and two-way flow of power and data from the sensor box and the sensor driver may materialize through the barrier of the PCR lid or any other similar barrier. In this case, the barrier is constructed from polymer with typical PCR wall thicknesses ranging between ~1 and ~5 mm.

It should be noted that the sensor shapes may be of any geometrical shape such as square, round or oval with sizes ranging, for example, from ~5 cm length x ~2.5 cm wide (or ~5 cm diameter). Smaller or larger sensors are envisaged. A camera may have a 10 cm length (or diameter).

The inductive mechanism components arrangement for both the TX and the RX side include components that package coil windings for TX and RX; such as: a formed pre-cast ferrite for Tx and Rx (A) that seats the said coil winding and acts as the inductive contact surfaces that fit and are snugly attached or connected one onto another. Both comprise a substantially flat, waterproof surface that ensures that no water, air or bubbles, dirt may enter between the Tx and the Rx flat surfaces when both are engaged, a heat sink to dissipate accumulated coil heat (B), a PCB (C), an antenna PCB for communications between TX, RX and vice versa (D), the said magnet to magnet or magnet to a matching metal, water sealing gaskets for the TX and the RX (E), O-rings (F) (all not shown)

The DPU may be connected to the PCR using a clip connection for locking and release of a sensor box. A PCR may include a wheel, a track, water inlet and a water outlet that are the input and output of a one or more fluid paths within the PCR.

There may be provided a flat bottom sensor where the sensor box also penetrated into a depression on the PCR housing surface to have the inductive coil connect directly with the inductive coil of the sensor driver that is located on the inside of one of the motor unit vertical walls that is facing the accessory. Namely, the sensor or the accessory box snugly fits and presses against the external motor unit wall to contact the inductive coil. Either a magnetic connection and/or a spring plunger type securing is or are applicable. The sensor box is detachable and may be removed at the split line. Not shown are the sealing and gasket arrangement at the split line to fend off water penetration into the housing. See, for example, FIG. 3.

Instead of the depicted circular sensor shape, the sensor 100 may be configured to be shaped as a cylinder having, for example, a diameter of 1 cm up to ~5 cm that is inserted to snugly fit against the external motor unit wall. Multiple such cylinder type sensors may fitted in this same manner (see FIG. 16 for reference).

Having the said inductive coil located inside the sealed motor unit requires it to be factory fitted by the OEM or a licensed service center.

The DPU and the PCR may be coupled using a galvanic power and data transfer connection between the sensor box and the sensor driver. The galvanic contacts are made of brass that is resistant to corrosive materials that do not corrode even when under prolonged electrical load. In order to create corrosion in the brass contacts DC voltage is required between these contacts but in practice the average voltage at points B is zero. See, for example, FIG. 7.

There may be provided a detachable and removeable rechargeable battery that powers the PCR motor unit and its electronics circuitries, processor, computerized software programs, sensors or added-on accessories. In order to retrieve and remove the battery, a handle is provided. See, for example, FIG. 9A.

The battery or module is constructed of a plastic housing body that contains the battery cells that are connected to form a battery pack that is connected to a controlling PCB that is further connected to the TX induction coils section. The TX defined here is in the sense that the battery pack inductively transmits electrical energy to power the PCR and also data. The data transmitted from the battery involves: (A) status data of the batteries and the battery pack and its condition. For example, internal battery pack temperature (B) or a level of humidity using an internal probe (C), longevity of the battery cells (D). The PCB may be encapsulated inside the PCB box (E) using epoxy resin casting (F). The said battery pack section and the PCB are wired to interconnect the inductive coil arrangement compartment.

When the said removeable rechargeable battery pack is inserted into the PCR through a slot, the inductive coil arrangement compartment progresses inward in the housing to the limit where it cannot move any further; and/or it may also be held in position and fastened by a stopper or a battery clip connection. The coil reaches a position where it is facing the inductive coil RX that may be a permanent fixture of the PCR. The RX defined here is in the sense that the RX inductively receives the battery electromagnetic power and transmits it to power the PCR motor unit; it also transmits any data received from the TX, as referred to above. It will be disclosed further-on how the said RX also acts as a TX and the said TX acts as an RX.

The detachable and removeable rechargeable battery may be is inserted longitudinally along the length of a PCR housing side. The battery TX and RX coils arrangements are electrically wired to the motor unit. The PCR filtering unit is positioned within the hydraulic path leading from a water inlet to a water outlet. A battery hinged cover closes the said battery slot to prevent debris or sucked water from penetrating. The said hinged cover may include a gasket or an O-ring to seal the opening (not shown). The suction force of the PCR pumping may keep this cover closed tightly. Additional spring cover locking mechanism may also be incorporated. See, for example, FIG. 9B.

There may be provided a battery pack that is inserted transversely, through a slot, along the width of the PCR in a position where the coil reaches a position where it is facing and in close-fitting with the inductive coil RX. The inductive RX coil is assembled onto RX/TX coil arrangement, PCB and cable connections assembly that may be a permanent fixture of the PCR. See, for example, FIG. 10.

There may be provided two electrical cable wiring and their waterproof cable connections, which exit the RX and that, in unison, are configured to function as the RX/TX coil arrangement, PCB and cable connections assembly. The first power and data cable wiring to floating unit is connected at its other end to a solar floating unit and antenna, that floats at the swimming pool water line. As will be explained, the said solar floating unit provides, amongst other, electrical charging power to charge the battery. The second power and data cable to motor unit direct the battery power to the motor unit that includes the main PCR control card, at least one of a drive and pump motors and an impeller.

The RX/TX coil arrangement, PCB and cable connections assembly is configured so that cable connection prongs are inserted into the hollow housing of the PCR via the separating wall of the PCR housing. Both integrated cable connection prongs protrude into the inside of the said housing allowing extension of the cables towards the said floating unit and to the motor unit. The said prongs may be secured onto the housing from the inside by a hex nut. The cables may be attached onto the said prongs by such threaded waterproof cable connections that include a cable gland.

As stated above, in some applications the transmitter and receiver functions may alternate. Namely, the RX and the TX may perform alternately. Electrical power may be transmitted or flow from a power supply source (power supply, transformer or battery)—in a first direction—to a device or an accessory that receives said power. For example: a battery power source (TX) may power a sensor (RX). That same battery may also be inductively charged when being charged from an external power transmitter. So, the TX will function and will be defined as an RX for the purpose of charging a battery.

Data may also be transmitted between a TX and an RX. An RX sensor such as an optical camera, may receive both (a) power to operate and (b) operating commands from a central electronic control management such as: to switch-on, to optically scan environment and to transmit back captured data. Data flows from the TX to the RX and back from the RX to the TX.

Because in this specification the power and/or data may flow in both ways (TX to RX and back), the terminology of RX or TX is alternate in the sense that the electrical and data flows may alternate i.e.: inverse their flow directions; this may be related each time to the actual and specific process occurring in this two-way flow process.

The battery may be removed or inserted into the inner space (See, for example, FIG. 11). When the said battery is pulled out of the housing or from the PCR, it detaches from PCB and cable connections assembly. When it is reinserted, it connects with the solar power float and with the motor unit.

Importantly, like any rechargeable battery in the prior art, any of the batteries depicted in this specification and the drawings in FIGS. 9A-13 may be recharged externally in a dedicated recharger that is located external to the pool and that is powered by any type of power supply (not shown). This is particularly relevant when an end user owns multiple such batteries and wishes to keep his PCR working even when low lighting or sun conditions provide low radiation energies (night-time, cloudy skies and the like) to power photovoltaic cells of a floating solar panel or, energy is available only relatively limitedly in for example, a commercial or Olympic sized indoors swimming pool.

At least two batteries can be used concurrently in a PCR. The advantage here is that the batteries slide into the slot (in this case a longitudinal slot running along the lengths or the PCR) to physically connect with the vertical wall(s) of the motor unit. See, for example, FIGS. 12 and 13. In other words, inductive coil arrangement that belongs to the battery, connects with the inductive coil arrangement that is located inside the motor unit. Namely, similarly to the configuration in FIG. 4, the battery snugly fits and presses against the external motor unit wall to contact the inductive coil that is facing the battery. The two-way power and data flows process between the TX and the RX is configured to materialize through the motor unit housing wall that usually is constructed from a polymer. Again, having the said inductive coil located inside the sealed motor unit requires it to be factory fitted by the OEM or a licensed service center.

When at least two batteries are installed in the PCR, they are both recognized, and both transmit their status data to the float and/or to the motor unit control. There is nevertheless also provided a battery separation and a switchover circuit mechanism in order to: (a) prevent batteries from short-circuiting (b) ensure use-up of the first battery power before switching over to using the second battery power. The said control unit may decide when to switch over the power usage—and from which battery—according to the reading of the battery charge capacity.

When a said first battery was depleted and power is now consumed from the second battery, a message is sent to the end user to replace the used battery with a fresh charged one.

At least two batteries, with quick turnarounds, may be particularly applicable in larger pools (Olympic sizes); where lengthier cleaning cycle times may be required. The shift to cordless, battery operated PCR, meaning the removal of the long tethered cables (at times 30-40 meters long), may provide pool operators with a favourable solution.

A spring plunger type securing may be applicable to holding the battery in place.

It should be noted that in the event of an end user preferring is compelled to using only one inserted battery, a dummy battery of identical weigh may be provided so to keep the weight distribution of the PCR intact.

There may be provided a floating unit, controls and antenna that includes such on-off button, operating status LED, an antenna for wireless communications between the submerged PCR and an end user computer device (handheld phone, tablet and the like). See, for example, FIG. 14. The data transfers are two-way: (a) the PRP transmits and feeds all the necessary status of the sensor(s) and battery (ies) to the ends user (b) the end user may transmit operating commands to the PCR thereby overriding an automatic program cleaning with a manual remote-control cleaning and/or modification of cleaning or operating parameters. The said float may further include a sensor or accessory inductive RX/TX box attachment (1,16,17) to any of the sides of the said float that may be removably and detachably connected to a RX/TX driver box. The choice of sensor(s) or accessory/ies is already defined in this specification. A camera TX/RX arrangement may be attached to the bottom of the float for navigation purposes.

It should be noted that the said float is wired via cable to the PCR TX/RX inductive battery arrangements in the PCR—as specified. When such a floating unit is in service, it may require that the end user will manually recharge the PCR batteries for lack of any additional external charging facility or utility. See, for example, FIG. 15.

An additional battery charging utility may be provided in the form of a solar floating unit, controls and antenna. The solar panel and photovoltaic cells on board the said float may power the PCR or recharge its battery/ies via power and data cable to float that, on its one end, connects the said float to the RX/TX coil arrangement, PCB and cable connections assembly, at its other end (as discussed under FIGS. 10 and 11).

There may be provided an arrangement of sensors or accessories removably attached to a side of the PCR housing. See, for example, FIG. 16. The said sensors or accessories may include a multiple sensor/accessory box and driver and/or a shaped sensor box and driver and/or a single sensor/accessory. Any sensor but particularly an array of sensors arrangements as depicted may be protected by a hinged sensor cover that may provide prevent accidental detachment of a sensor or accessory but also an aesthetic cover to complement the PCR contours.

There may be provided a PCR add-on camera accessory box and a camera driver. In the planning and engineering of PCR, there could be fitted a camera that forms an integral part of the PCR at an OEM level. These could be sophisticated cameras combining 3D views, RGB lighting and the like. Meaning, the end user may purchase such a specific PCR model camera included. There is a need to allow end users to install an add-on camera at will. Such a camera may be purchased separately, and the user may connect it—plug and socket—to an already provided for RX/TX sensor connection or accessory. Such after sale installations are also provided for as DIY or at approved service centers. See, for example, FIG. 17.

As already stated, motor unit control includes an automatic connection discovery of the new box and the at least one sensor or accessory when the boxes' TX and RX and drivers are connected; Namely, the moment the camera is attached the control applies an automatic turn-on of the camera and the applying of specific commands and control to the camera TX/RX arrangement and for each of the at least one sensor or accessory. The said camera may be equipped with a lighting outlet for camera use in dark surroundings or conditions zoom an/or a rotating angle lens and at least an additional sensor.

There may be provided cables that may be used to connect PCR batteries. The wiring pins shown may be resin over molded while the wire gauge ranges from 16-20 AWG. There could be provided a two-pin configuration where one pin leads positive electrical power and the second a negative. A 3-pin (See, for example, FIG. 18) will employ the third wiring pin for data transfers. A 4-pin (See, for example, FIG. 19) configuration will have the third and the fourth pin transferring data where the fourth is configured to contain twisted ethernet cable wiring for ethernet interface connectivity, such as a Cat 5, Cat 5e ethernet cable and the like. The said four pin cable connection in this specification is suited for the data that is transferred between the RX/TX connection to the floats and their wireless connectivity to cloud based servers using cable.

Any reference to the terms "including", "comprising", "having", may be applied mutatis mutandis to any one of "consisting" and "consisting essentially of".

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and "the like" in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

Any system, apparatus or device referred to this patent application includes at least one hardware component.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

Any combination of any component of any component and/or unit of pool cleaning robot that is illustrated in any of the figures and/or specification and/or the claims may be provided.

Any combination of any pool cleaning robot illustrated in any of the figures and/or specification and/or the claims may be provided.

Any combination of any set of pool cleaning robots illustrated in any of the figures and/or specification and/or the claims may be provided.

Any combination of steps, operations and/or methods illustrated in any of the figures and/or specification and/or the claims may be provided.

Any combination of operations illustrated in any of the figures and/or specification and/or the claims may be provided.

We claim:

1. A pool related platform (PRP) comprising:

a body; and a detachable sensor unit (DSU) that comprises multiple sensors and DSU wireless power interface, the DSU is detachably coupled to the body; and a PRP wireless power interface that is configured to participate in a wireless power transfer with the DSU wireless power interface; and at least one rotating unit that is configured to introduce a rotational movement about one or more axes of rotation between (a) the body and (b) the DSU and the PRP wireless power interface.

2. The pool related platform according to claim 1 wherein the DSU is detachably coupled to the body via at least one of a magnetic connection, a mechanical hook connection, a protuberance and recess connection, a pin and spring connection, or a clip connection.

3. The pool related platform according to claim 1 wherein the at least one rotating element comprises a rod movable along a horizontal axis thereby elevating or lowering one side of the DSU, thereby causing the DSU to rotate along a rotation axis located at another side of the DSU.

4. The pool related platform according to claim 1 wherein the at least one rotating unit is configured introduce the rotational movement about multiple axes of rotation.

5. The pool related platform according to claim 1 wherein the at least one rotating unit comprises a pitch angle rotating unit and a yaw angle rotating unit.

6. The pool related platform according to claim 1 wherein at least two of the multiple sensors differ from each other by type.

7. The pool related platform according to claim 6 wherein the type is selected out of a visual sensor and a non-visual sensor.

8. The pool related platform according to claim 1 wherein a field of one of the multiple sensors is oriented to a field of view of another sensor of the multiple sensors.

9. The pool related platform according to claim 1 wherein the DSU comprises a housing that comprises multiple facets, wherein at least two sensors of the multiple sensors are located at least two different facets of the multiple facets.

10. The pool related platform according to claim 1 wherein the DSU wireless power interface comprises a DSU inductive coil, the PRP wireless power interface comprises a PRP indictive coil; wherein the DSU comprises a DSU communication unit; wherein the PRP comprises a PRP communication unit; wherein the DSU communication unit and the PRP communication unit 118 are configured to wirelessly communicate using the PCR inductive coil and the DSU inductive coil.

11. The pool related platform according to claim 1 wherein the DSU wireless power interface is located within a protuberance of the DSU, wherein the body comprises a recess that matches the protuberance of the DSU.

12. The pool related platform according to claim 1 wherein the DSU comprises a DSU wireless communication unit that is configured to preform wireless communication with a wireless communication unit of the body.

13. The pool related platform according to claim 1 wherein the multiple sensors comprise at least one out of turbidity sensors, salinity sensors, chlorine level sensors, PH level sensors, ORP sensors, distance sensors, depth sensors, temperature sensors.

14. The pool related platform according to claim 1 wherein the multiple sensors comprise at least one out of imaging sensors, underwater cameras, navigation cameras, 3D cameras, constituents recognition cameras, dirty areas recognition sensors, navigation sensors, active sensors, passive sensors, compasses, magnetometers, gyroscopes, GPS based location sensors, inertial measurement sensors, acoustic sensors, pressure sensors, odometers, visual lasers, white light sensors, coloured light sensors, infra-red sensors, drowning recognition microphones.

15. The pool related platform according to claim 1, further comprising: a detachable power source (DPS) that comprises a DPS housing, one or more batteries and a DPS wireless power interface; and wherein the body comprises in inner space for receiving the DPS.

* * * * *